United States Patent [19]

Bousaid

[11] 3,976,137

[45] Aug. 24, 1976

[54] RECOVERY OF OIL BY A COMBINATION OF LOW TEMPERATURE OXIDATION AND HOT WATER OR STEAM INJECTION

[75] Inventor: Issam S. Bousaid, Houston, Tex.

[73] Assignee: Texaco Inc., New York, N.Y.

[22] Filed: June 21, 1974

[21] Appl. No.: 481,579

[52] U.S. Cl. ..... 166/272

[51] Int. Cl.[2] ..... E21B 43/24

[58] Field of Search ..... 166/261, 260, 251, 256, 166/259, 272; 208/11

[56] References Cited

UNITED STATES PATENTS

| | | | |
|---|---|---|---|
| 3,150,715 | 9/1964 | Dietz | 166/261 |
| 3,196,945 | 7/1965 | Craig et al. | 166/261 |
| 3,208,519 | 9/1965 | Moore | 166/261 |
| 3,727,686 | 4/1973 | Prates et al. | 166/261 |

FOREIGN PATENTS OR APPLICATIONS

| | | | |
|---|---|---|---|
| 840,789 | 5/1970 | Canada | 166/272 |

*Primary Examiner*—Stephen J. Novosad
*Assistant Examiner*—George A. Suckfield
*Attorney, Agent, or Firm*—T. H. Whaley; C. G. Ries; Charles L. Bauer

[57] ABSTRACT

A method for the recovery of low gravity viscous oil or bitumens from a subterranean formation by the injection of a mixture of an oxygen-containing gas and hot water or steam into either the upper or lower section of the formation wherein the ratio of oxygen to water is used to control the oxidation temperature.

20 Claims, 1 Drawing Figure

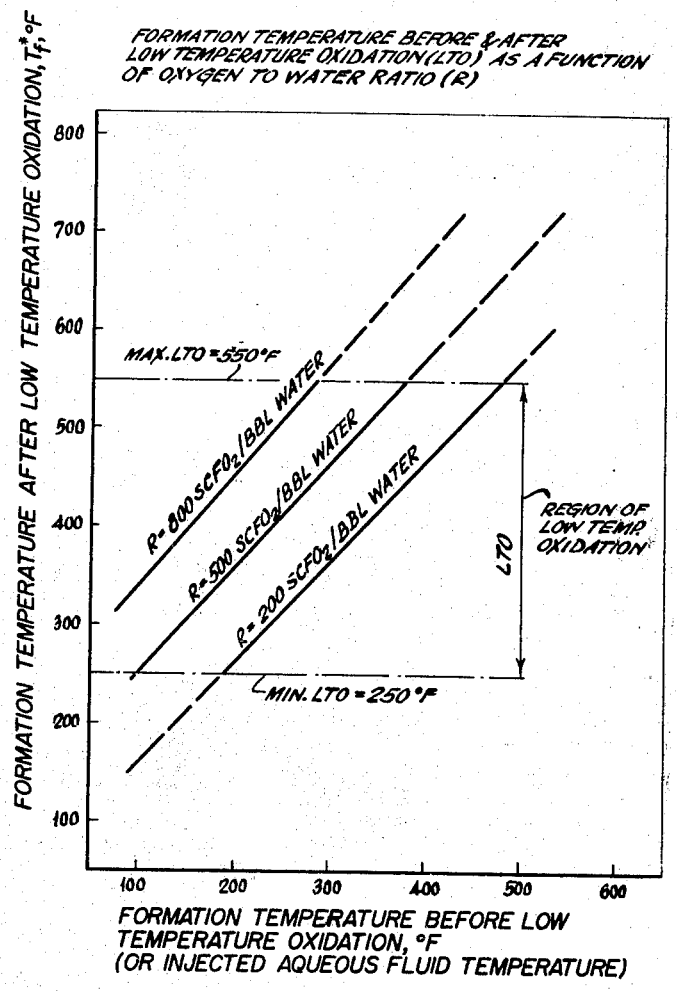

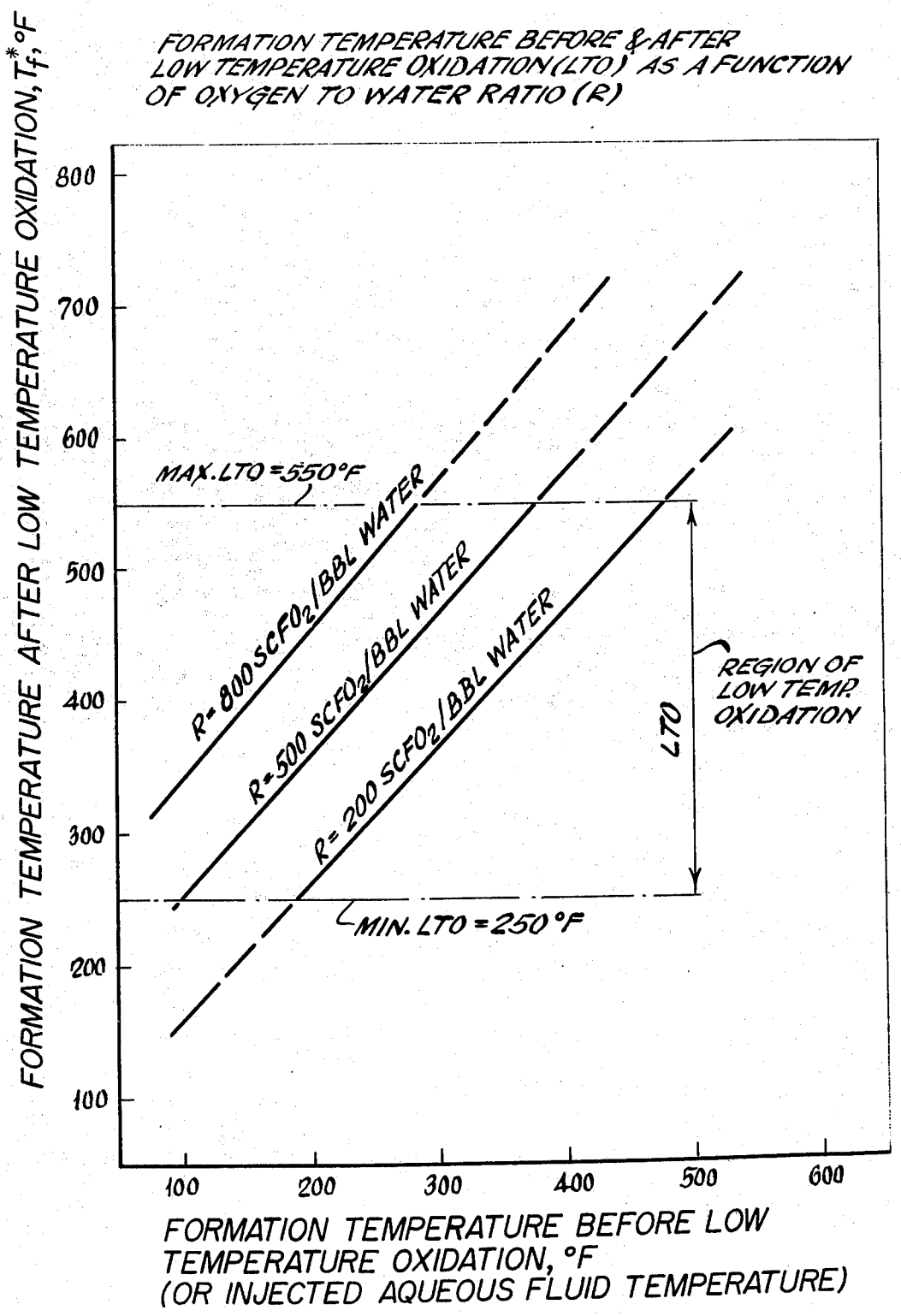
FORMATION TEMPERATURE BEFORE & AFTER LOW TEMPERATURE OXIDATION (LTO) AS A FUNCTION OF OXYGEN TO WATER RATIO (R)
FORMATION TEMPERATURE AFTER LOW TEMPERATURE OXIDATION, $T_f^*$, °F
800
700
600
500
400
300
200
100
MAX. LTO = 550°F
MIN. LTO = 250°F
R = 800 SCF$O_2$/BBL WATER
R = 500 SCF$O_2$/BBL WATER
R = 200 SCF$O_2$/BBL WATER
LTO
REGION OF LOW TEMP. OXIDATION
100
200
300
400
500
600
FORMATION TEMPERATURE BEFORE LOW TEMPERATURE OXIDATION, °F
(OR INJECTED AQUEOUS FLUID TEMPERATURE)

RECOVERY OF OIL BY A COMBINATION OF LOW TEMPERATURE OXIDATION AND HOT WATER OR STEAM INJECTION

BACKGROUND OF THE INVENTION

The present invention relates to an improved method for the recovery of oil from subterranean hydrocarbon bearing formations containing low API gravity viscous oils or bitumens. More particularly, the invention relates to the production of bitumens and hydrocarbons from reservoirs of low mobility such as tar sand formations.

The recovery of viscous oils from formations and bitumens from tar sands has generally been difficult. Although some improvement has been realized in stimulating recovery of heavy oils, i.e., oils having an API gravity in the range of 10° to 25° API, little, if any, success has been realized in recovering bitumens from tar sands. Bitumens can be regarded as highly viscous oils having a gravity in the range of about 4° to 10° API and contained in an essentially unconsolidated sand referred to as tar sands.

Vast quantities of tar sands are known to exist in the Athabasca region of Alberta, Canada. While these deposits are estimated to contain several billion barrels of oil or bitumen, recovery therefrom using conventional in situ techniques has not been too successful. The reason for the lack of success relate principally to the fact that the bitumen is extremely viscous at the temperature of the formation, with consequent low mobility. In addition, these tar sand formations have very low permeability, despite the fact they are unconsolidated.

Since it is known that the viscosity of oil decreases markedly with an increase in temperature, thereby improving its mobility, thermal recovery techniques have been investigated for recovery of bitumens from tar sands. These thermal recovery methods generally include steam injection, hot water injection and in situ combustion.

Typically, such thermal techniques employ an injection well and a production well traversing the oil-bearing or tar sand formation. In a steam operation employing two wells, steam is introduced into the formation through the injection well. Upon entering the formation, the heat transferred by the hot fluid functions to lower the viscosity of oil, thereby improving its mobility, while the flow of the hot fluid functions to drive the oil toward the production well from which it is produced.

In the conventional forward in situ combustion operation, an oxygen-containing gas, such as air, is introduced into the formation via a well, and combustion of the in-place crude adjacent the well bore is initiated by one of many known means, such as the use of a downhole gas-fired heater or a downhole electric heater or chemical means. Thereafter, the injection of the oxygen-containing gas is continued so as to maintain a combustion front which is formed, and to drive the front through the formation toward the production well.

As the combustion front advances through the formation, a swept area consisting, ideally, of a clean sand matrix, is created behind the front. Ahead of the advancing front various contiguous zones are built up that also are displaced ahead of the combustion front. These zones may be envisioned as a distillation and cracking zone, a condensation and vaporization zone, an oil bank and a virgin, or unaltered zone.

The temperature of the combustion front is generally in the range of 650°–1200°F. The heat generated in this zone is transferred to the distillation and cracking zone ahead of the combustion front where the crude undergoes distillation and cracking. In this zone, a sharp thermal gradient exists wherein the temperature drops from the temperature of the combustion front to about 300°–450°F. As the front progresses and the temperature in the formation rises, the heavier molecular weight hydrocarbons of the oil become carbonized. These coke-like materials are deposited on the matrix and are the potential fuel to sustain the progressive in-situ combustion zone.

Ahead of the distillation and cracking zone is a condensation and vaporization zone. This zone is a thermal plateau and its temperature is in the range of from about 200° to about 450°F., depending upon the distillation characteristics of the fluid therein and formation pressure. These fluids consist of water and steam and hydrocarbon components of the crude.

Ahead of the condensation and vaporization zone is an oil bank which forms as the in-situ combustion front progresses and the formation crude is displaced toward the production well. This zone of high oil saturation contains not only reservoir fluids, but also condensate, cracked hydrocarbons and gaseous products of combustion which eventually reach the production well from which they are produced.

Various improvements relating to in-situ combustion are described in the prior art that relate to the injection of water, either simultaneously or intermittently with the oxygen-containing gas to scavenge the residual heat in the formation behind the combustion front, thereby increasing recovery of oil. Prior art also discloses regulating the amount of water injected so as to improve conformance or sweep and to control the cumbustion.

Experience has generally shown that these conventional thermal techniques have not been altogether successful when applied to the recovery of heavy oils or bitumen. Where the hydrocarbons sought to be produced have a low API gravity, the build-up of the oil bank ahead of the thermal front occurs to a great extent. Since the heat transfer is low ahead of the front, these heavy hydrocarbons become cool and hence immobile, thereby causing plugging of the formation with the result that the injection of either air in the case of in-situ combustion, or steam in the case of steam is greatly restricted.

Furthermore, in the case of in-situ combustion, when applied to heavy oils the high molecular weight fractions are carbonized. These carbonaceous deposits serve as the fuel for the in-situ combustion reaction, but because the oil contains such a high percentage of these fractions, very high fuel requirements are incurred with consequent low recovery and high oxygen requirements.

The difficulties recited above become compounded when these techniques are applied to the tar sands, because not only do the bitumens have a low API gravity, i.e., 6–8° API and a higher viscosity, i.e., in the millions of centipoises, but also the permeability of the tar sands is so low that difficulty has been experienced in establishing fluid communication within the formation.

Accordingly, it is an object of the present invention to provide an improved recovery method whereby both highly viscous low gravity crudes and bitumens can be recovered more efficiently. The instant invention accomplishes this by a combination of in-situ low temperature oxidation and hot water or steam injection into the upper or lower portion of the formation whereby the oxidation is controlled by the selecting of the ratio of the oxygen in the oxygen-containing gas to the water that is injected either as hot water or steam.

SUMMARY OF THE INVENTION

This invention relates to an improved method of recovering low gravity viscous oils and more particularly to the production of bitumens from tar sands by the injection of a mixture of an oxygen-containing gas and hot water or steam into the upper or lower portion of the net sand thickness wherein the ratio of oxygen to water is controlled to insure a stable low temperature oxidation; thus, first: minimizing the possibility of plugging the flow channels and maintaining communication between wells, and second: heating a greater area of the formation than by conventional in-situ combustion.

BRIEF DESCRIPTION OF THE DRAWING

The figure indicates the relationship between the temperature of the formation before and after low temperature oxidation as a function of the oxygen-to-water ratio.

DESCRIPTION OF THE PREFERRED EMBODIMENT

This invention relates to the production of a low gravity viscous hydrocarbon or a bitumen from tar sands by the combination of low temperature oxidation of the low gravity crude or bitumen and hot water or steam injection wherein the ratio of oxygen in the oxygen-containing gas to the water injected either as hot water or steam is controlled, so as to maintain a low temperature oxidation recovery process. This low temperature combustion occurs at a temperature lower than the conventional in-situ combustion process.

In recovery of the bitumen from tar sand, it is necessary that continuous fluid communication between the injection well and the offset producing wells be established such that all injected fluids as gas and liquids can flow through suh channels without being restricted by plugging of the formation either by the solids of the sand matrix or by the immobile bitumens.

A second requirement is that the heat exchange between the heat source and the tar sand is caused to occur principally in a vertical direction almost normal to the fluid flow lines. The heat source is either furnished by in-situ generation of heat or by a hot fluid injected into the formation through the established flow channels.

I have found that these two requirements may be satisfied by the use of an injection mixture of an oxygen-containing gas and a hot aqueous fluid, such as hot water or steam wherein the tar sand temperature is controlled within the range of about 250° to 550°F. by controlling the quantity of oxygen to water in the injection mixture. These temperatures, it is seen, are much lower than the temperatures attained in a conventional in-situ combustion which are of the order of 650°F. or higher.

By this method of operation, a low temperature oxidation occurs in the formation wherein the oxygen is consumed at a slower rate over a greater distance from the injection well, thereby heating a greater area of the formation than occurs with conventional in-situ combustion.

The injection of the hot water or the steam with the oxygen-containing gas stabilizes the oxidation temperature and also supplies additional heat to even greater areas encompassed by the flow channels which increases with time.

The greatest advantage of the simultaneous injection of heated water or steam is its efficiency to carry or sweep most of the bitumen that is released from the matrix upon being heated. The bitumen becomes very mobile at low or moderate temperatures and is easily displaced by the hot water or steam before the bitumen is cooled into an immobile phase. Thus, the combination of air or an oxygen-containing gas and heated aqueous fluid injected through a bitumen containing matrix will: 1) Heat a large area of the formation by low temperature oxidation, 2) Displace and recover most of the heated bitumen through the initially established flow channels by the hot water or steam, and 3) Maintain communication between wells.

The oxygen-containing gas and the heated aqueous medium can be injected either alternately or simultaneously and in a ratio of oxygen-to-water of about 200–800 SCF of oxygen per barrel of water. The relationship between the formation temperature before and after low temperature oxidation as a function of this oxygen-to-water ratio is shown in the FIGURE. Preferably, the ratio is about 500 SCF of oxygen per barrel of water as shown by the middle curve in the FIGURE.

In operation, the location of the continuous flow channel can be either at the upper or lower end of the net sand thickness containing a bitumen. In the situation where the continuous flow channel is in the upper section, continuity between the injection and the producing well is maintained due to gravity differences between the gas and the liquids; and the cooling water tends to wash the sand matrix downward while allowing the heated bitumen to rise into the main flow channels free of solids, thus minimizing sand production problems.

In the use of the lower section for the continuous flow channel, the heat exchange will be transferred upward into the bitumen section thus enhancing rapid drainage of the heated bitumen into the main flow channels where it is carried and swept by the flowing water. The option of selecting the upper or lower section of the formation for injecting fluids is based on minimizing sand production problems in one case and increasing the heat exchange process in the other case.

An added advantage of the method of operation is that the small quantity of carbon dioxide produced by the low temperature oxidation "goes into" solution in the bitumen which further enhances its mobility. Furthermore, the presence of gs such as nitrogen aids in establishing a gas saturation and thus aids in maintaining communications channels.

In one method of practicing the invention, at least one injection well and one producing well are drilled into the oil-bearing formation and a flow channel is established at the lower section between the two wells, in some cases where necessary by the use of fracturing techniques or by the use of a solvent.

Thereafter, a mixture of an oxygen-containing gas and a hot aqueous fluid, either hot water or steam, is injected into the formation via the injection well wherein the ratio of the oxygen in the oxygen-containing gas to the water in the hot aqueous fluid is in the ratio of about 500 SCF to 1 barrel of water. The preferred range of this ratio can be determined from heat balance method so that the temperature in the formation is maintained in the range of from 250°–550°F as shown in the FIGURE.

The preferred gas may be air, or oxygen-enriched gas or gas consisting substantially of pure oxygen. The hot aqueous fluid may be either hot water, saturated steam or superheated steam, with the important criteria being that the rates be adjusted so as to be in the range of 500 SCF oxygen per 1 barrel of water as indicated in the FIGURE.

The low temperature oxidation (LTO) occurs by absorption or "take up" of oxygen by the hydrocarbon molecule with little if any carbon oxides being formed. The rate of LTO is primarily dependent on temperature; as the temperature increases, the oxidation rate increases exponentially until the oxygen is totally consumed. For this reason, oxidation at a temperature lower than that obtained by conventional in-situ combustion for heavy oils or bitumen is desirable in order to reduce the oxidation rate and allow more oxygen to react further away from the thermal zone and heat a greater area of the formation. This process enhances gradual heating of the tar sand without plugging the flow channels. At a given point in the formation each oxygen molecule will react and release in-situ heat to the bitumen. The simultaneous injection of hot water or steam is used to minimize or prevent large increases in the oxidation rate by controlling the formation temperature.

For a given oxygen-to-water ratio injected, the oil-bearing formation will reach a temperature at which the oxidation rate becomes stable and, thus, the formation temperature is controlled by this ratio. Based on these findings, a heat balance equation can be derived between heat generated by oxidation of the injected oxygen and heat stored in the formation. The following derivation of the heat balance equation illustrates the relation between the increase in formation temperature by LTO as a function of the ratio of oxygen to water injected.

Since most of the in-situ heat generated by LTO is gained by the formation, not heat losses to areas outside the heated region are considered in this derivation.

Heat Generated by Oxidation = Heat Stored in Formation $$(\Delta H_{O_2})\, V_{O_2} = (\rho c_{P_r} + \rho c_{P_r})\, \Delta T \qquad 1.$$

and $$\Delta T = \frac{(\Delta H_{O_2}) V_{O_2}}{(\rho c_{P_r} + \rho c_{P_f})}, \text{°F} \qquad (2)$$

Let the oxygen to water ratio, R, in SCF of $O_2$ per barrel of water be $$R = V_{O_2}/V_w \qquad 3.$$

and $V_w$, the water volume in a cubic foot of rock is $$V_w = \frac{\Phi S_w}{5.615}, \text{ bbl of water/ft}^3 \text{ of rock} \qquad (4)$$

thus, the oxygen volume becomes, from Eqs. 3 and 4

$$V_{O_2} = V_w R = \left(\frac{\Phi S_w}{5.615}\right) R, \text{ SCF of } O_2/\text{ft}^3 \text{ of rock} \qquad (5)$$

and Equation 2 becomes $$\Delta T = \frac{(\Delta H_{O_2})\left(\frac{\Phi S_w}{5.615}\right) R}{(\rho c_{P_r}) + (\rho c_{P_f})}, \text{°F} \qquad (6)$$

where:

$\Delta T$ = increase in formation temperature by oxidation, °F.

$\Delta H_{O_2}$ = heat of oxidation of hydrocarbons ≅ 500 BTU/SCF of oxygen (near constant)

$V_O$ = Oxygen volume consumed, SCF of $O_2$/ft³ of rock $\phi$ = fractional porosity of formation $S_w$ = fractional water saturation in pore volume R = injected oxygen to water ratio, SCF of $O_2$/bbl of water $\rho c_{P_r}$ = specific heat of rock matrix only, BTU/ft³-°F.

$\rho c_{P_f}$ = specific heat of fluids (oil + water only), BTU/ft³-°F.

In applying the equation to an example for the Athabasca Tar Sands the following parameters have been used:

Example Calculations: For the Tar Sands of Alberta:

$\phi = 0.40$ $S_{w_i} = 0.30$, initial water saturation, fraction of pore volume $S_{O_i} = 0.60$ $S_{g_i} = 0.10$ $T_f$ = formation temperature affected by injected fluids $T_{f=} = T_f + \Delta T$, formation temperature after oxidation, °F.

Other parameters for Equation 6 are:

| Formation Temp. °F = | 130 | 300 | 525 |
|---|---|---|---|
| Water Sat. $S_w$ | 0.30 | 0.35 | 0.40 |
| Oil Sat., $S_o$ | 0.60 | 0.55 | 0.50 |
| Oil Density, g/cc, $\rho o$ | 0.99 | 0.93 | 0.84 |
| Water Density, g/cc, $\rho w$ | 1.0 | 0.92 | 0.75 |
| Sand Density, g/cc, $\rho s$ | 2.67 | 2.67 | 2.67 |
| Sp. Heat, Oil, $c_{P_o}$ | 0.50 | 0.58 | 0.66 |
| Sp. Heat, Water, $c_{P_w}$ | 1.0 | 1.01 | 1.05 |
| Sp. Heat, Sand, $c_{P_s}$ | 0.20 | 0.217 | 0.24 |

*$c_p$ is in BTU/lb-°F.

The $c_P$ terms in Equation 6 are defined below in BTU/ft³-°F.

$$\rho c_{P_r} = 62.4\,(1-\phi)\,\rho_s c_{P_s}$$

and $$\rho c_{P_f} = \phi(S_o \rho_o c_{P_o} + S_w \rho_w c_{P_w})\, 62.4$$

Equation 6 becomes:

$$\Delta T = \frac{(500)\,\frac{\Phi S_w}{5.615}(R)}{62.4[(1-\Phi)\,\rho_s c_{P_s} + \Phi(S_o \rho_o c_{P_o} + S_w \rho_w c_{P_w})]}$$

$$\Delta T = \frac{1.43\, S_w (R)}{[(1-\Phi)\,\rho_s c_{P_s} + \Phi(S_o \rho_o c_{P_o} + S_w \rho_w c_{P_w})]} \qquad (7)$$

Thus, the increase in formation temperature is calculated by Equation 7 as a function of the ratio, R. Substituting the parameters in Equation 7 for each formation temperature, For $T_f = 130°F$, Equation (7) is $$\Delta T = 0.306\ R,\ °F \quad (8)$$

For $T_f = 300°F$, $\Delta T = 0.335\ R,\ °F$ (9)

For $T_f = 525°F$, $\Delta T = 0.367\ R\ °F$ (10)

Using R = 500 SCF of $O_2$/bbl of water, the formation temperature $T_{f=}$ after oxidation becomes:

$$T_f^* = T_f + \Delta T = 130 + 153 = 283°F$$
$$= 300 + 167 = 467°F$$
$$= 525 + 183 = 708°F$$

Where $I_f$ is the formation temperature before LTO. Based on Equation 7, the relationship between formation temperature before oxidation and after oxidation by LTO is shown in the FIGURE for three oxygen-to-water ratios. The injected ratio of 500 SCF of oxygen per barrel of water is an average value and is sufficient for formation temperatures up to 380° F. Above this temperature a lower ratio of oxygen to water can be used in the field, as low as 200 SCR $O_2$/bbl. water. However, during the initial stage of the project, when $T_f$ is below 300°F. a higher ratio, up to 800 SCF of $O_2$ per barrel of water can be applied to speed up the heating process of the formation. The same procedure can be applied to other oil formations relating the ratio of oxygen to water to the desired increase in formation temperature by the LTO process.

I claim:

1. A method for the recovery of hydrocarbons from a subterranean hydrocarbon-bearing formation traversed by at least one injection well and at least one production well connected by flow channels, comprising the steps of;

a. injecting into a portion of said formation via said injection well a mixture of an oxygen-containing gas and a heated aqueous fluid to effect a low temperature oxidation in a temperature range of from about 250° to about 550°F of said hydrocarbons adjacent said injection well, wherein the ratio of the oxygen in said oxygen-containing gas to the water in said aqueous fluid is in the range of about 200 to about 800 SCF of oxygen per barrel of water, b. continuing injection of said mixture to maintain said low temperature oxidation to heat said hydrocarbons in the neighborhood of said flow channels, c. displacing said hydrocarbons via said flow channels toward said production well, d. producing said hydrocarbons from said production well.

2. The method of claim 1 wherein said portion of said formation into which said mixture is injected is the upper portion of said formation.

3. The method of claim 1 wherein said portion of said formation into which said mixture is injected is the lower portion of said formation.

4. The method of claim 1 wherein said $O_2$-containing gas is air.

5. The method of claim 1 wherein said $O_2$-containing gas is substantially pure $O_2$.

6. The method of claim 1 wherein said heated aqueous fluid is hot water.

7. The method of claim 1 wherein said heated aqueous fluid is steam.

8. The method of claim 1 wherein said ratio is about 500 SCF of oxygen per barrel of water.

9. A method for the recovery of hydrocarbons from a subterranean hydrocarbon-bearing formation traversed by at least one injection well and at least one production well connected by flow channels, comprising the steps of;

a. injecting into the upper portion of said formtion via said injection well a mixture of an oxygen-containing gas and a heated aqueous fluid to effect a low temperature oxidation in a temperature range of from about 250° to about 550°F of said hydrocarbons adjacent said injection well, wherein the ratio of the oxygen in said oxygen-containing gas to the water in said aqueous fluid is in the range of about 200 to about 800 SCF of oxygen per barrel of water, b. continuing injection of said mixture to maintain said low temperature oxidation to heat said hydrocarbons in the neighborhood of said flow channels, c. displacing said hydrocarbons via said flow channels toward said production well, d. producing said hydrocarbons from said production well.

10. The method of claim 9 wherein said oxygen-containing gas is air.

11. The method of claim 9 wherein said oxygen-containint gas is substantially pure oxygen.

12. The method of claim 9 wherein said heated aqueous fluid is hot water.

13. The method of claim 9 wherein said heated aqueous fluid is steam.

14. The method of claim 9 wherein said ratio is about 500 SCF of oxygen per barrel of water.

15. A method for the recovery of hydrocarbons from a subterranean hydrocarbon-bearing formation traversed by at least one injection well and at least one production well connected by flow channels, comprising the steps of;

a. injecting into the lower portion of said formation via said injection well a mixture of an oxygen-containing gas and a heated aqueous fluid to effect a low temperature oxidation in a temperature range of from about 250° to about 550°F of said hydrocarbons adjacent said injection well, wherein the ratio of the oxygen in said oxygen-containing gas to the water in said aqueous fluid is in the range of about 200 to about 800 SCF of oxygen per barrel of water, b. continuing injection of said mixture to maintain said low temperature oxidation said production well and to heat said hydrocarbons in the neighborhood of said flow channels, c. displacing said hydrocarbons via said flow channels toward said production well, d. producing said hydrocarbons from said production well.

16. The method of claim 15 wherein said oxygen-containing gas is air.

17. The method of claim 15 wherein said oxygen-containing gas is substantially pure oxygen.

18. The method of claim 15 wherein said heated aqueous fluid is hot water.

19. The method of claim 15 wherein said heated aqueous fluid is steam.

20. The method of claim 15 wherein said ratio is about 500 SCF of oxygen per barrel of water.

* * * * *